US005205341A

United States Patent [19]

Treul et al.

[11] Patent Number: 5,205,341

[45] Date of Patent: Apr. 27, 1993

[54] LOW PRESSURE DOUBLE ARM CASTING APPARATUS

[75] Inventors: Frederick F. Treul, Milwaukee; Thomas R. Hoesly, Oconomowoc; William F. Mackay, Waukesha, all of Wis.

[73] Assignee: Starline Manufacturing Company, Inc., Milwaukee, Wis.

[21] Appl. No.: 485,748

[22] Filed: Feb. 27, 1990

[51] Int. Cl.[5] ..... B22D 18/04; B22D 33/00

[52] U.S. Cl. ..... 164/306; 164/309

[58] Field of Search ..... 164/309, 306, 323

[56] References Cited

U.S. PATENT DOCUMENTS

| | | | |
|---|---|---|---|
| 1,913,945 | 6/1933 | Morris et al. | 164/309 |
| 3,804,152 | 4/1974 | Cook et al. | 164/309 X |
| 4,103,734 | 8/1978 | Mikotin et al. | 164/309 |

FOREIGN PATENT DOCUMENTS

| | | | |
|---|---|---|---|
| 474171 | 6/1951 | Canada | 164/309 |
| 0175833 | 4/1986 | European Pat. Off. | 164/306 |
| 2533847 | 4/1984 | France | 164/306 |
| 58-221655 | 12/1983 | Japan | 164/306 |
| 649567 | 2/1979 | U.S.S.R. | 164/323 |
| 1324757 | 7/1987 | U.S.S.R. | 164/306 |

*Primary Examiner*—J. Reed Batten, Jr.
*Attorney, Agent, or Firm*—Foley & Lardner

[57] ABSTRACT

A low pressure brass or bronze casting apparatus includes a pedestal, a low pressure casting furnace disposed in a spaced relation to the pedestal, a pair of immersion stations located in an equally spaced relation to the pedestal, a pair of arms mounted for rotary motion on the pedestal, a mold manipulator assembly mounted on each of the arms and being disposed for movement into operative engagement with the immersion station and the furnace, one of the arms being independently rotated between the furnace and one of the immersion stations and the other of the arms being independently rotated between the furnace and the other of the immersion stations.

2 Claims, 9 Drawing Sheets

LOW PRESSURE DOUBLE ARM CASTING APPARATUS

BACKGROUND OF THE INVENTION

1. Field of the Invention

This invention relates to a low pressure casting apparatus and more particularly to a casting apparatus having two independent manipulator arms mounted for independent motion with respect to a single low pressure furnace.

2. Description of the Prior Art

Low pressure casting of brass or bronze castings generally employ a low pressure furnace which is filled with molten metal, the molten metal being forced through an ascending pipe or pipes in the furnace into the mold or molds. The molds are mounted in various ways for step by step movement in sequence into engagement with the ascending pipe of the furnace. The molds are simultaneously moved to a discharge station where the casting is removed, a washing station for cleaning the mold surfaces and a core setting station for placing a core in the mold. In order to efficiently produce castings, one of the essential requirements is to present the molds to the furnace in a timed alternating sequence.

One system which achieves this function is disclosed and described in U.S. Pat. No. 4,431,046 entitled "Automated Low Pressure Casting Mechanism and Method" issued on Feb. 14, 1984. In this system, a number of mold manipulators are mounted on a revolving table or carousel which is rotated to sequentially position one of the molds on the casting furnace. The molds must be sequenced in steps in order to discharge, wash and set cores in the molds prior to being presented to the furnace. In this patent, the sequence of steps is controlled by the time required to fill the mold, which is the longest time required for any of the steps. If for any reason one of the mold manipulators becomes inoperable due to breakage of the mold or breakdown of the system, the entire system must be shut down until the manipulator is replaced or the mold is repaired or replaced. The productivity of the furnace is lost during such a shutdown period. Additional productivity of the system is lost due to the time required to bring the system back to ideal operating conditions.

SUMMARY OF THE INVENTION

The casting apparatus according to the present invention includes two mold manipulator arms which are independently mounted on a pedestal and a conventional low pressure furnace positioned in close proximity to the pedestal. A pair of immersion type wash stations are located on each side of the furnace and are equally spaced from the furnace and from the pedestal. Each of the independent arms are then rotated independently from the furnace to one of the immersion stations and back to the furnace. With this arrangement, one of the molds will always be approaching or positioned at the furnace while the other mold is moving through the discharge, wash, mold coating and core setting stations. In the event one of the molds should break down, the other mold can be continually cycled to produce product while the other mold is being repaired or replaced.

One of the principal advantages of the invention is the continued use of the furnace during repair or replacement of the other mold. This results in a greater efficiency in the operation of the system since it does not have to be shut down during replacement or repair of one mold or manipulator.

A further advantage is the ability to add metal to the furnace while the apparatus is operating.

A still further advantage is the reduction in down time when mold changes, or try outs are required.

Other features and advantages of the embodiments of the invention will become apparent upon review of the following drawings, detailed description and appended claims.

BRIEF DESCRIPTION OF THE DRAWINGS

FIG. 8, arm A is at the furnace station and arm B is at the wash station.

FIG. 9, arm A is at the furnace station and the mold on arm B is rotating toward a vertical position.

FIG. 10, arm A is at the furnace station and the mold on arm B is at the vertical position.

FIG. 11, arm A is starting to move off the furnace and arm B is rotating toward a horizontal position for core setting.

FIG. 12, arm A is rotating to the eject station; arm B is at the core setting position.

FIG. 13, arm A is at the eject station; the mold on arm B is closing on the core.

FIG. 14, the mold on arm A is opening; the manipulator on arm B is moving toward the vertical position.

FIG. 15, arm A is at the eject station; arm B is moving toward the furnace.

FIG. 16, arm A is moving toward the wash station; arm B is moving toward the furnace.

FIG. 17, arm A is at the wash station; arm B is at the furnace.

FIG. 18, arm A is at the wash station; arm B is in the filling position at the furnace.

FIG. 19, arm A is rotating to a vertical position at the wash station; arm B is lifting off of the furnace.

Figure 1:
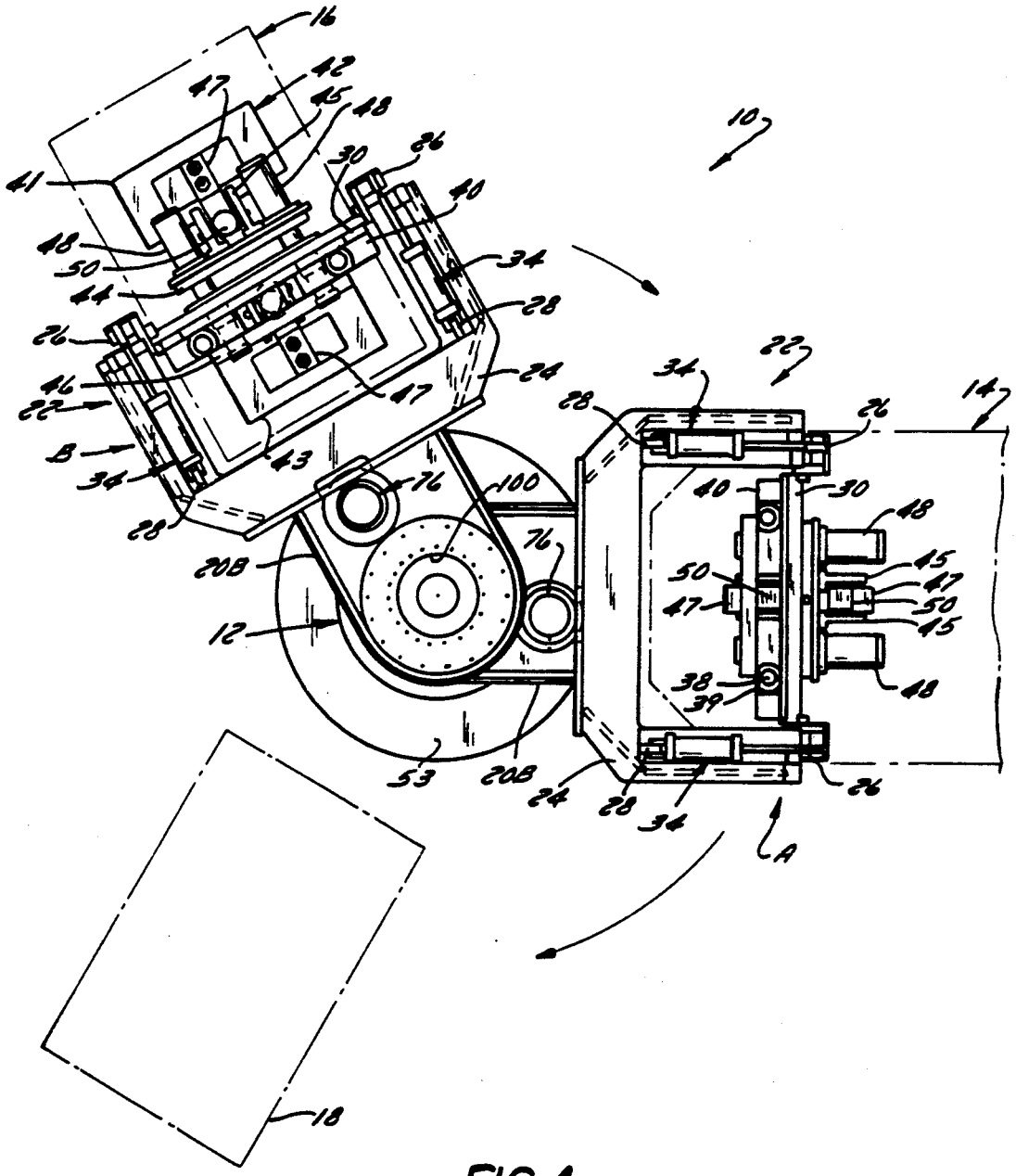
FIG. 1 is a top view of the casting apparatus showing the two independent manipulator arms.

Before describing at least one embodiment of the invention in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology employed herein is for the purpose of description and should not be regarded as limiting.

DETAILED DESCRIPTION OF THE PREFERRED EMBODIMENT

Figure 2:
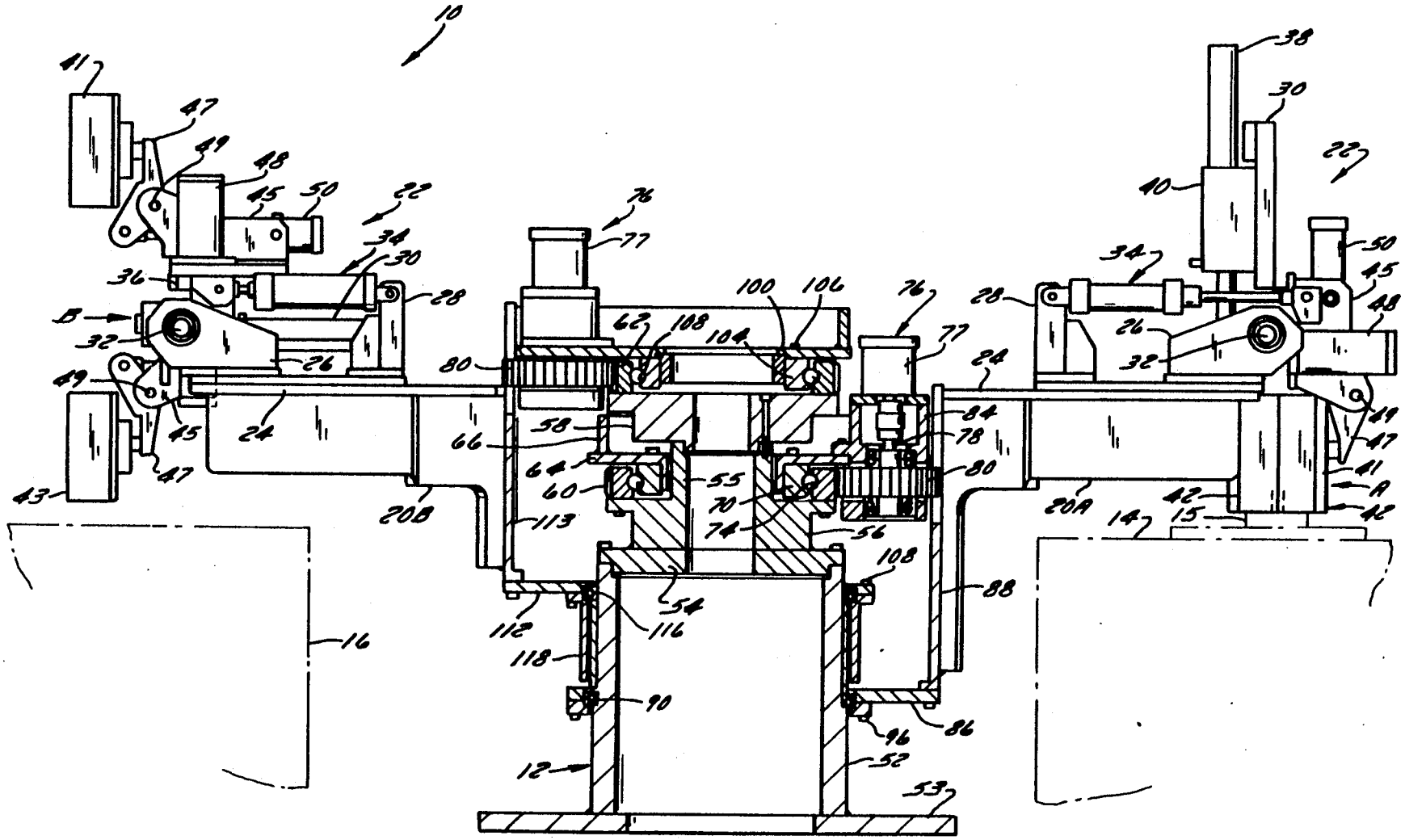
FIG. 2 is a side elevation view showing the disposition of the manipulator arms on the pedestal.

The double arm low pressure casting apparatus 10 as seen in FIGS. 1 and 2 generally includes a pedestal or cylindrical column 12 having a lower manipulator assembly A and an upper manipulator assembly B mounted for pivotal movement on the pedestal 12. A furnace 14 is shown schematically positioned in a spaced relation to the pedestal with the manipulator assembly A in alignment with the furnace. A pair of immersion or wash stations 16 and 18 are shown schematically on opposite sides of the pedestal and equally spaced from the furnace 14 and from the pedestal 12. The assembly A is movable in an arc between furnace 14 and wash station 18. The assembly B is movable in an arc between the furnace 14 and the wash station 16. The arc of movement of each of the manipulator assemblies is approximately 120°. An operator station is provided on each side of the pedestal between the furnace 14 and the wash stations 16 and 18.

The normal sequence of steps for each of the arms A and B is as follows: The lower manipulator assembly A is moved from the furnace 14 to a position to eject the casting. The assembly A is then moved to the wash station 18 for cleaning and mold coating by the operator. The motion of assembly A is then reversed for movement to a position where the operator sets a core in the mold before returning to the furnace. Similarly, the assembly B is rotated from the wash station 16 to a position to set the core in the mold. The arm B is then rotated to the furnace 14. On the return motion from the furnace 14 the assembly B is stopped to eject the casting before returning to the wash station 16. It should be noted that the sequence of movement of arm A is totally independent of the sequence of operation of arm B.

Figure 4:
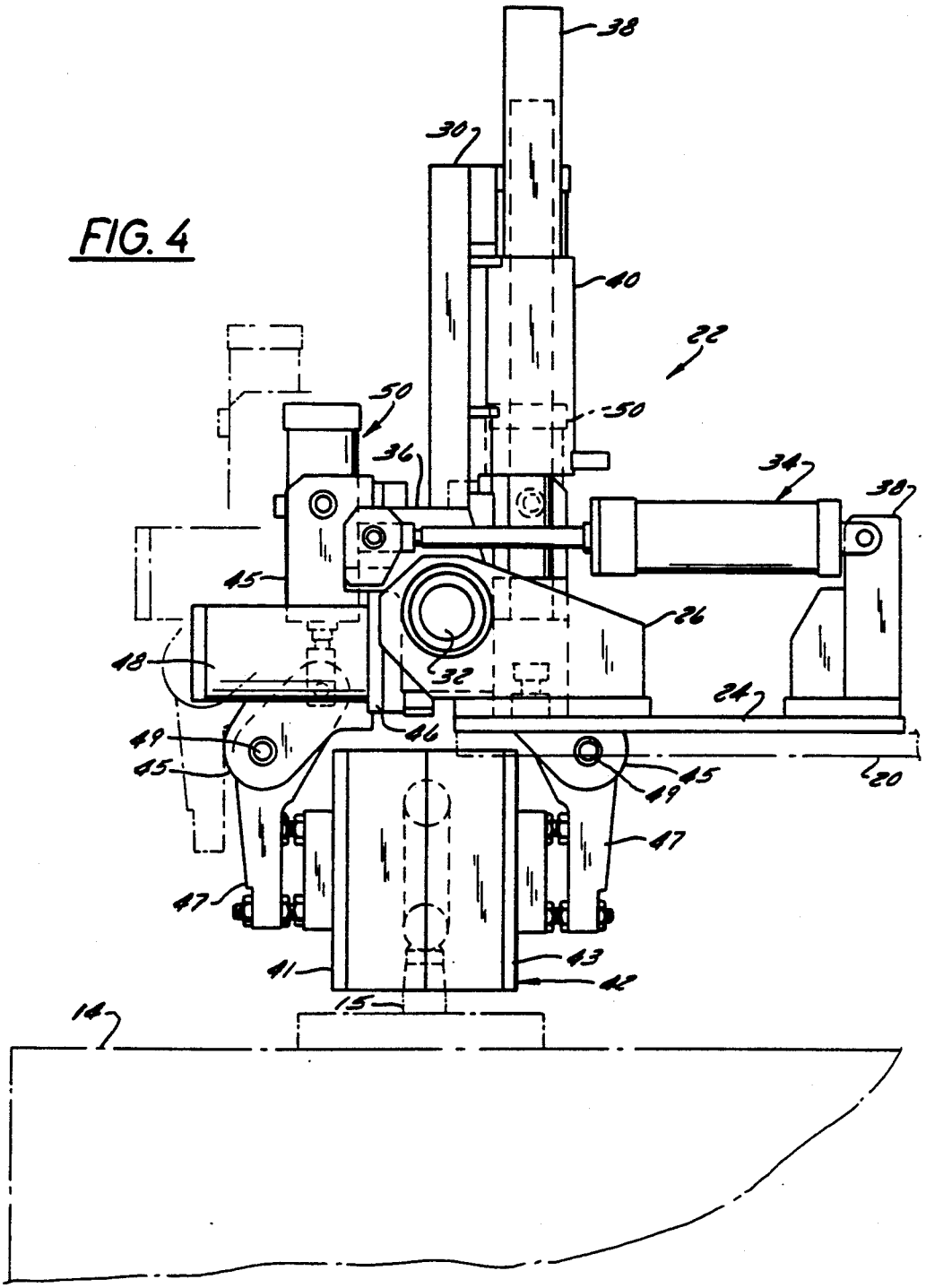
FIG. 4 is a side elevation view of the mold manipulator shown with the mold in the vertical position and aligned with the furnace.

The furnace 14 is a conventional type low pressure furnace which is normally filled with molten metal. The molten metal is forced under low pressure through pipes 15 into a mold 42 as seen in FIGS. 2 and 4. Although the mold 42 is shown as a double entry mold, other type molds can be used. The furnace 14 is arranged to be filled with additional metal without the necessity of stopping the operation of the casting apparatus. This is due to the independent action of the arms A and B which allows sufficient time between the movement of one arm onto the furnace and the movement of the other arm onto the furnace. This time difference allows the operator to add ingots to the furnace. The furnace is provided with an internal shelf for supporting one or more ingots prior to immersion in the melt. The ingot is thus preheated and forced into the melt by the addition of another ingot to the shelf.

Each of the manipulator assemblies A and B is generally of the same configuration and includes an arm 20A, 20B having a mold manipulator 22 mounted on the outer end. Each of the manipulators 22 is of a conventional configuration as seen in FIGS. 4–8. In this regard, each manipulator includes a pair of frame members 24 which are mounted on the upper surface of the arm 20. Each frame member 24 includes a pivot block 26 and cylinder support bracket 28. A U-shaped support frame 30 is mounted on shafts 32 which are pivotally mounted in the pivot blocks 26. A piston and cylinder assembly 34 is connected to the piston support plate 28 and to a pivot block 36 that is secured to the U-shaped frame 30. The piston and cylinder assembly 34 is used to move the frame 30 between horizontal and vertical positions with respect to the arms 20A, 20B.

A mold support plate 31 is supported on the frame 30 by means of two posts 38 which are aligned in cylindrical guides 39 provided on the back of frame 30. A pair of piston and cylinder assemblies 40 are mounted on the frame 30 and are connected to the plate 31 for controlling the disposition of the plate 31 with respect to the frame 30.

A split mold 42 having an upper section 41 and a lower section 43 is supported on the plate 31 by means of brackets 44 and 46. It should be noted that bracket 44 is secured to plate 31 and bracket 46 is supported on plate 31 by piston and cylinder assemblies 48 which are used to open and close the mold sections 41 and 43. The two half sections 41 and 43 are mounted for pivotal movement on brackets 46 and 44.

In this regard, a pair of pivot plates 45 are mounted on each of the brackets 44 and 46 for supporting a pivot pin 49. Each mold section 41 and 43 is pivotally mounted on pin 49 by means of a pivot arm 47. The mold sections are pivoted between open and closed positions by piston and cylinder assemblies 50 which are connected to brackets 45 and arms 47.

Figure 5:
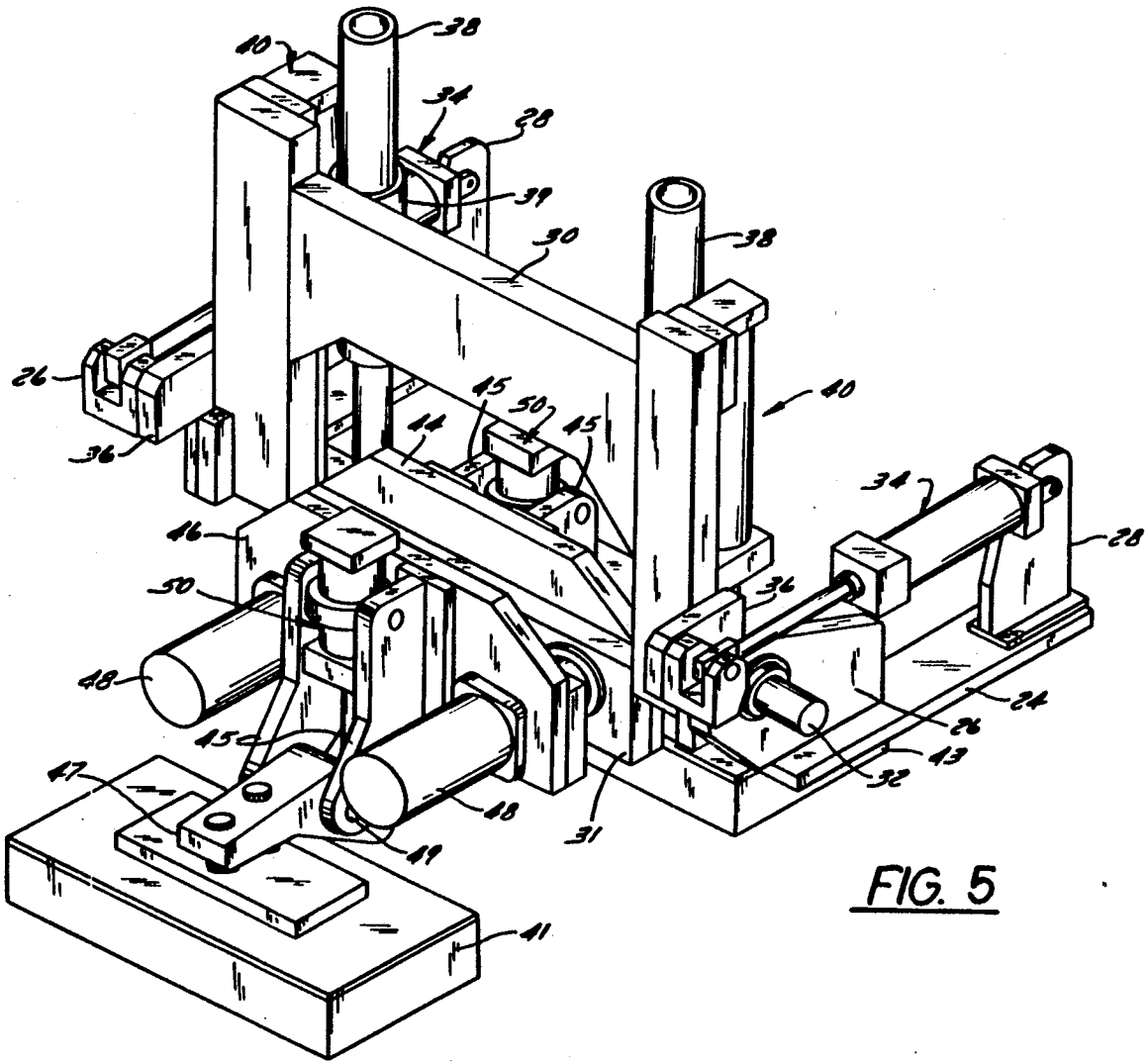
FIG. 5 is a perspective view of the mold manipulator in the vertical position with the mold opened for cleaning.
Figure 6:
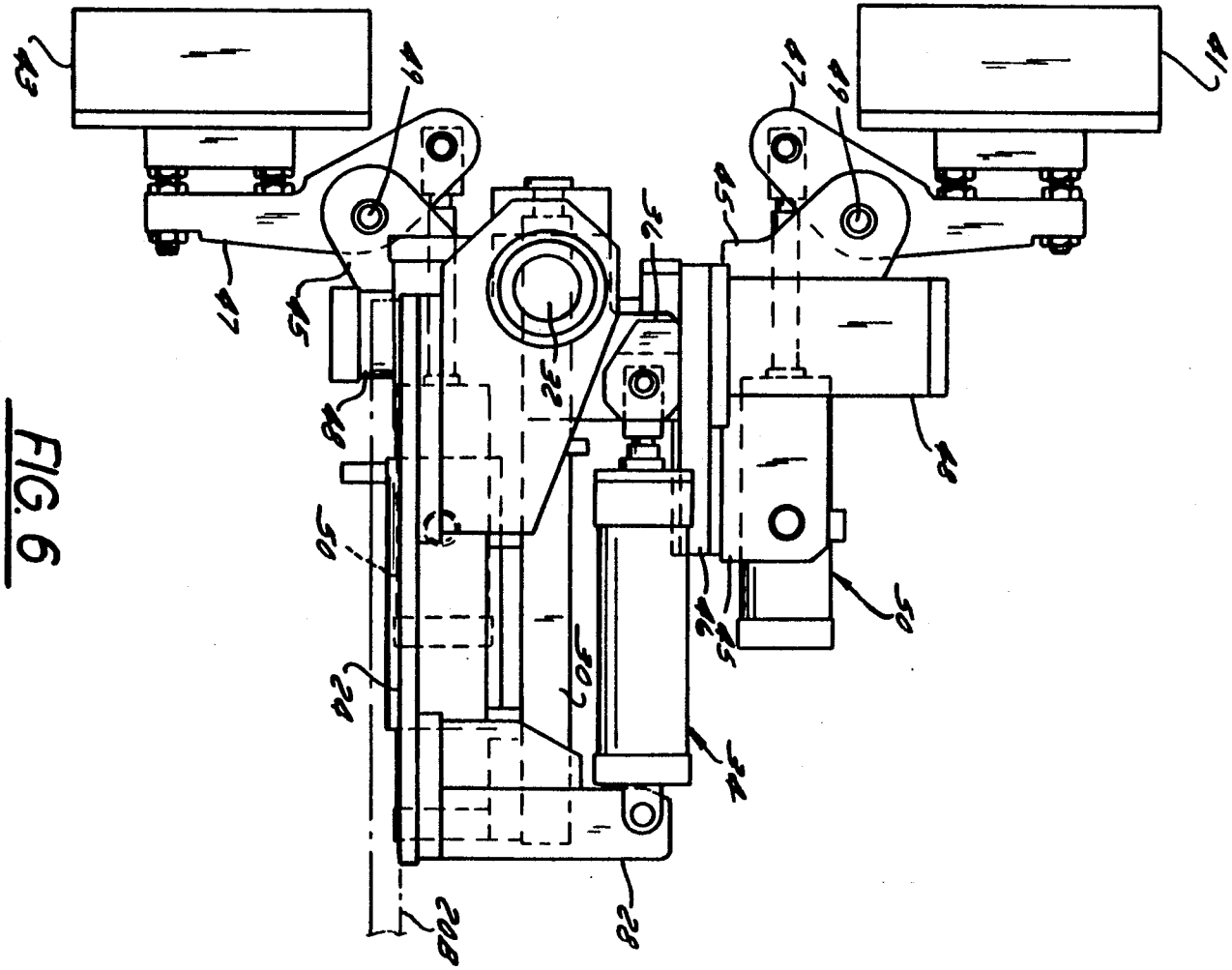
FIG. 6 is a view of the mold manipulator in the horizontal position with the mold opened.
Figure 7:
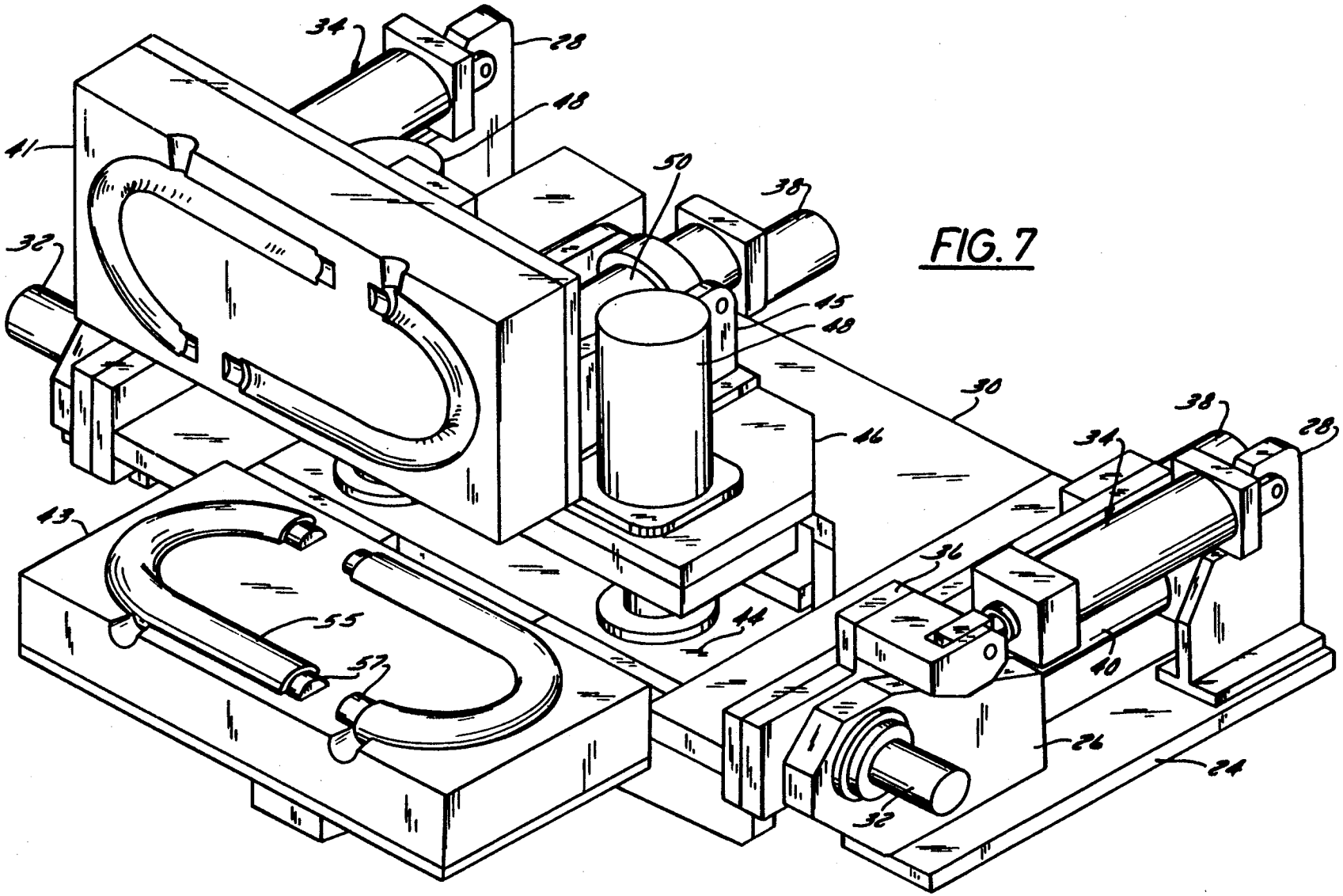
FIG. 7 is a perspective view of the mold manipulator in the horizontal position with the lower mold section in the horizontal position and the upper mold section in the vertical position with a core and casting shown in the lower mold section.

Referring to FIG. 4, the mold sections 41 and 43 are shown closed and positioned over the furnace 14. In FIG. 5, the mold sections 41 and 43 are shown in the open position for ejection of the casting and washing of the mold surfaces. In FIG. 6, the mold sections 41 and 43 are shown open and in a vertical position for mold coating. FIG. 7 shows the lower mold section 43 in a horizontal position and the upper mold section 41 in the vertical position. A core 51 and casting 57 are shown in the lower mold section 41.

Figure 3:
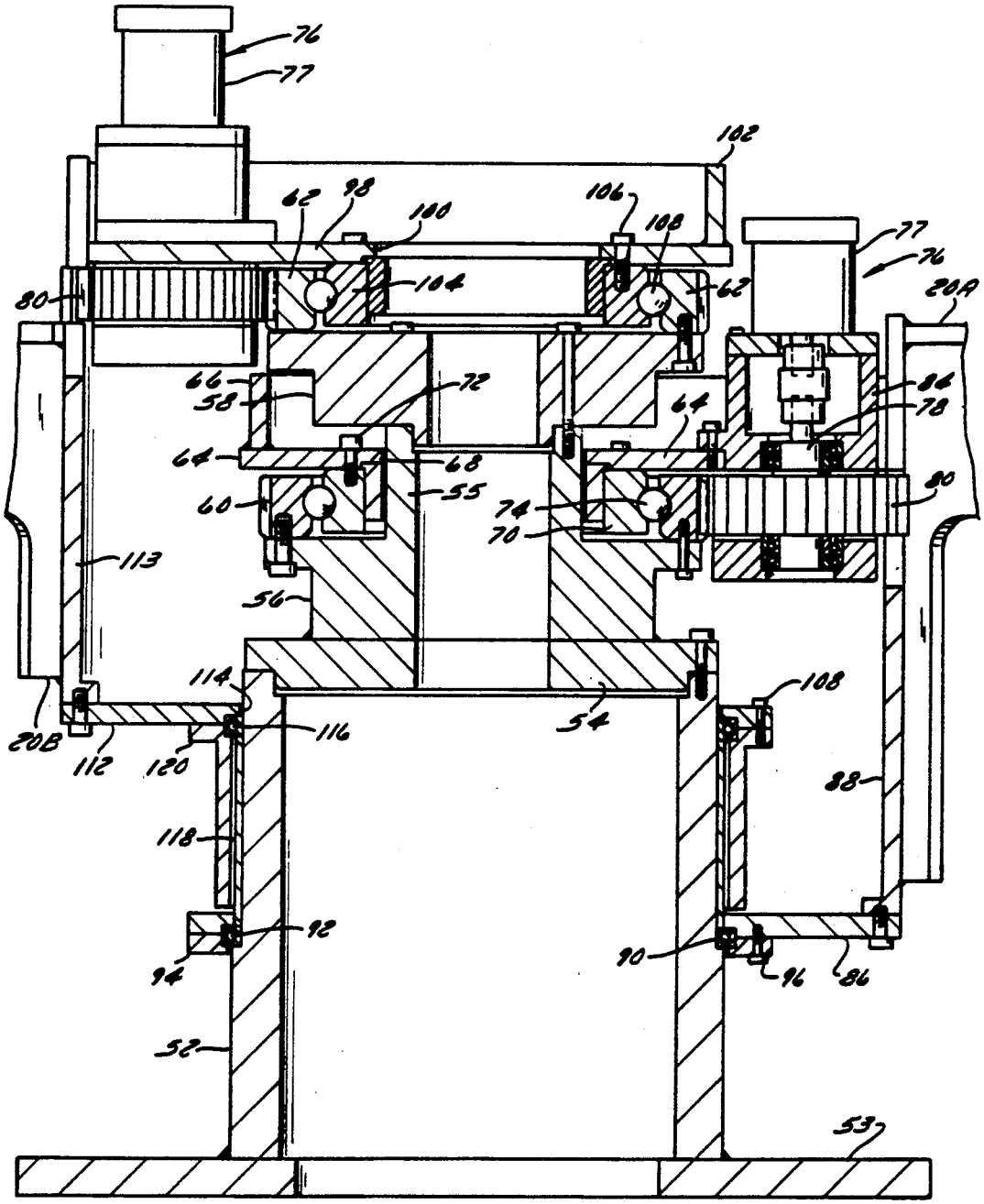
FIG. 3 is an enlarged view of a portion of FIG. 2 showing the bearing assemblies for mounting each of the manipulator arms on the pedestal.

In accordance with the invention, and referring to FIGS. 1, 2 and 3, the pedestal 12 includes a cylindrical base 52 secured to a base plate 53. A support plate 54 is mounted on the upper end of base 52. A lower cylindrical support member 56 is mounted on the plate 54 for supporting lower arm 20A. An upper cylindrical support member 58 is mounted on the lower support member 56 for supporting the upper arm 20B. A ring gear 60 is mounted on the support member 56 and a ring gear 62 is mounted on the support member 58.

The lower arm 20A includes a plate 64 having a flange 66 around the outer periphery. A hole 68 is provided in the plate 64 through which the upper portion 55 of support member 56 projects. Means are provided for radially supporting said arm on said pedestal. Such means is in the form of a radial bearing race 70 and a set of ball bearings 74. The bearing race 70 is secured to the plate 64 around the hole 68 by bolts 72 and the ball bearings 74 are mounted in said bearing race. The bearing race 70 is coaxially positioned within the ring gear 60. The ball bearings 74 are positioned between the bearing race 70 and the ring gear 60 to allow for pivotal movement of the arm 20A about the support member 56.

The lower arm 20A is supported at the lower end by means of a radial support bearing retainer plate 86 which is secured to a vertical plate 88 mounted on the arm 20A. A radial bearing 90 is mounted on a shoulder 92 provided on the cylinder 52. The radial bearing 90 is secured to the cylinder 52 by means of a ring 94 mounted on the plate 86 and secured thereto by bolts 96.

The lower arm 20A is pivoted with respect to the pedestal 12 by means of a drive assembly 76 mounted on the plate 64. The assembly 76 includes a housing 84 mounted on plate 64. A drive gear 80 is mounted for rotary motion in the housing and is positioned to engage ring gear 60. The drive gear 80 is driven by means of a reversible drive motor 77 which is connected to the drive shaft 78 for the drive gear 80.

The upper arm 20B includes a plate 98 having an opening 100 and a flange 102 around the outer periphery thereof. Means are provided for radially supporting the upper arm on said pedestal. Such means is in the form of a bearing race 104 and a set of ball bearings 108. The radial bearing race 104 is secured to the bottom of plate 98 by bolts 106 in a coaxial relation to the ring gear 62. Ball bearings 108 are positioned between the bearing race 104 and the ring gear 62. A drive assembly 76 as described above is mounted on plate 98 to rotate upper arm 20B with respect to the pedestal 12. The drive assembly 76 includes a reversible drive motor 77 to drive a gear 80 which is positioned to engage ring gear 62.

The upper arm 20B is supported on the cylinder 52 by means of a radial bearing retainer plate 112 which is secured to a vertical plate 113 mounted on arm 20B. The plate 112 includes an opening 114. A roller bearing 116 is mounted on the cylindrical member 52 and supported thereon by a cylindrical bearing retainer plate 118. The bearing 116 is retained in place by means of a cylindrical plate 120 which is connected to the plate 112 by bolts 108.

Referring to FIGS. 8 through 19, a series of schematic drawings are shown of the cycling positions of the manipulator assemblies A and B with respect to the furnace 14 and wash stands 16 and 18. Generally an operator stands near the wash stand to observe the cleaning of the mold, to coat the mold and to set the core 57 in the mold.

Figure 8:
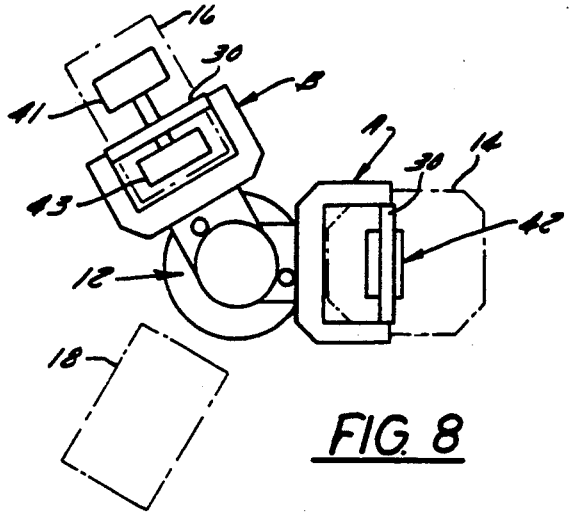
FIGS. 8 through 19 are schematic views of the casting apparatus showing the position of the arms A and B in relation to the furnace and wash stations.

FIG. 8, the manipulator assembly A is shown positioned at the furnace 14 with the mold 42 closed and ready to be filled. Assembly B is located at the wash stand 16 with the mold sections 41, 43 opened in a horizontal position for cleaning at the wash stand 16.

Figure 9:
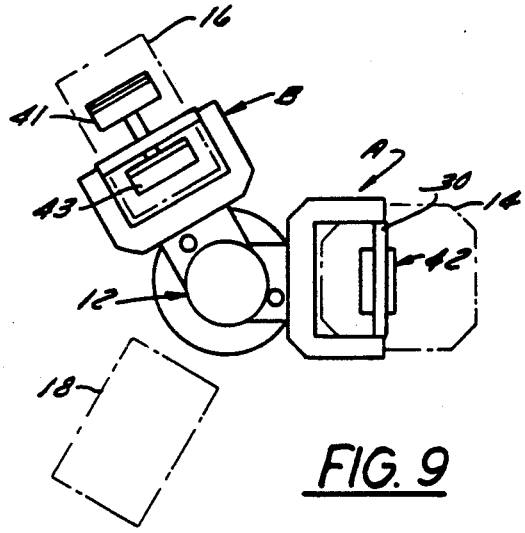

FIG. 9, in assembly A the mold 42 is filling with molten metal at the furnace 14. In assembly B the mold 42 is pivoting to a vertical position for mold coating.

Figure 10:
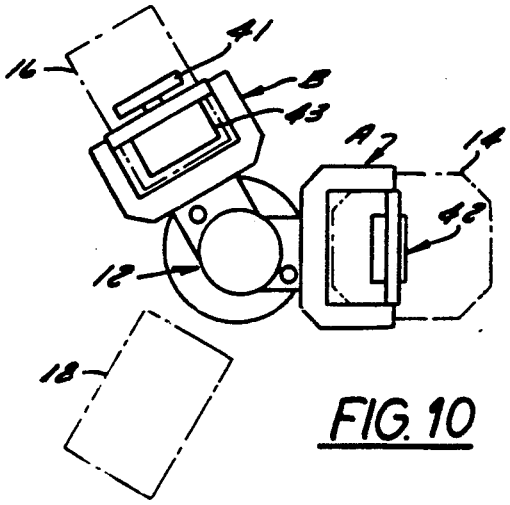

FIG. 10, the mold 42 in assembly A has been completely filled and the mold sections 41, 43 on assembly B are coated.

Figure 11:
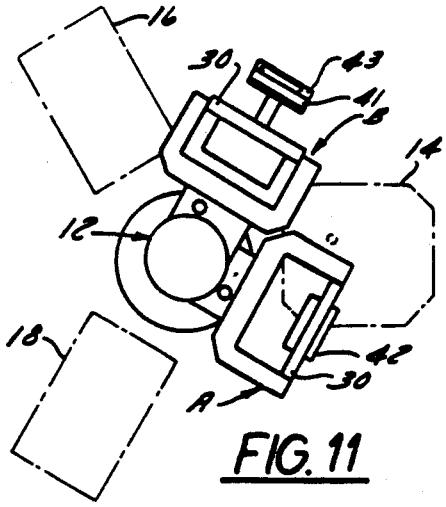

FIG. 11, the mold 42 on assembly A is lifted off the furnace 14 while the lower mold section 43 on assembly B is rotating to a horizontal position.

Figure 12:
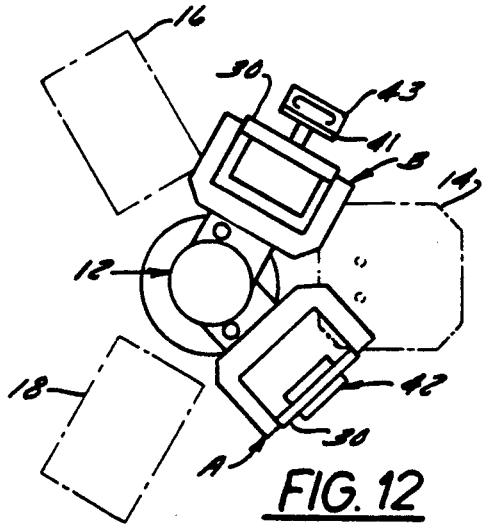

FIG. 12, assembly A is rotated away from the furnace 14 to a position to eject the casting by opening the mold. The lower mold section 43 in assembly B is located in a horizontal position so a core can be placed on the mold section 43.

Figure 13:
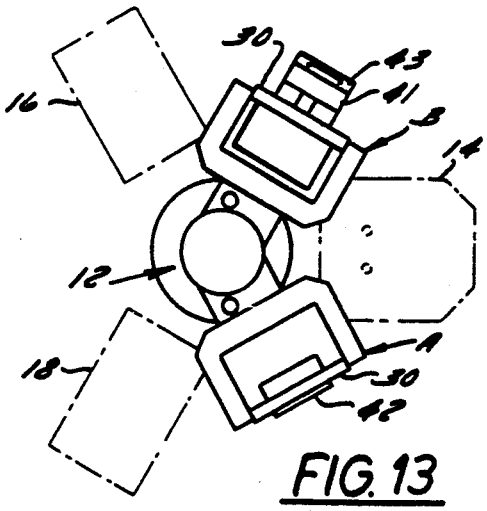

FIG. 13, the mold in assembly A is opening while the mold section 41 in assembly B is closing on mold section 43.

Figure 14:
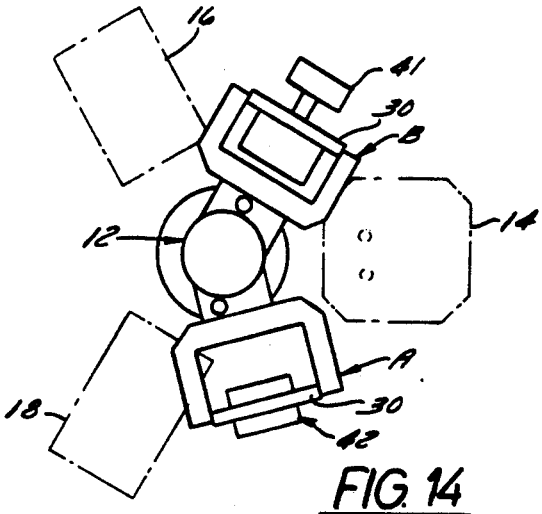

FIG. 14, the mold sections 41, 43 in assembly A are opening to eject the casting; the mold 42 in assembly B is completely closed and the assembly B is pivoting toward the furnace.

Figure 15:
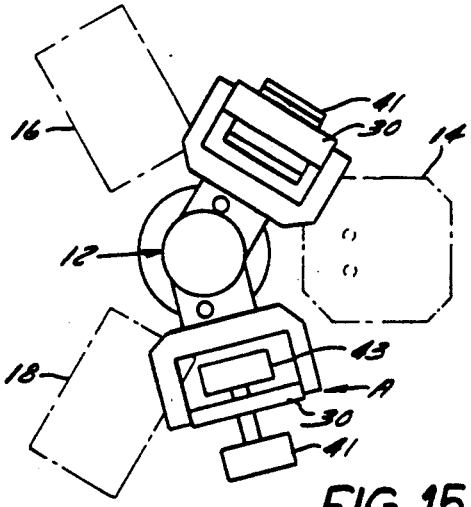

FIG. 15, assembly A is fully open for washing; assembly B is rotating toward the furnace 14 with the mold 42 rotating to a vertical position.

Figure 16:
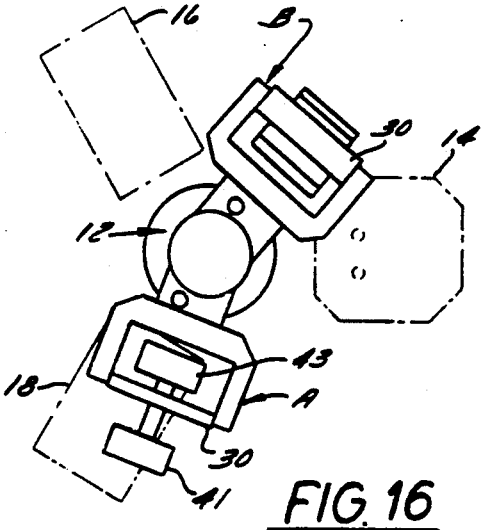

FIG. 16, the assembly A is moving toward the wash stand, while assembly B is moving toward the furnace.

Figure 17:
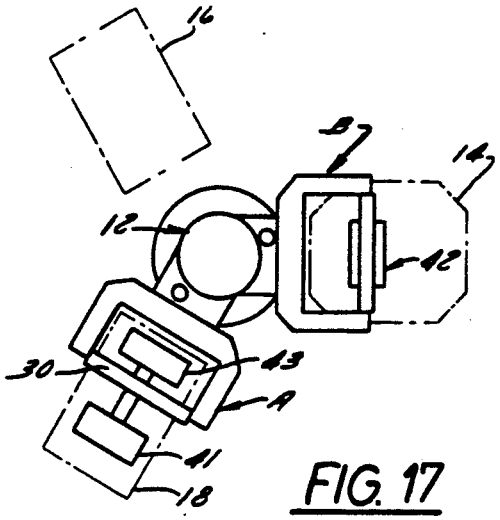

FIG. 17, assembly A is located at the wash stand for cleaning of the mold sections 41, 43 while assembly B has been moved to the furnace and the mold 42 aligned with the furnace.

Figure 18:
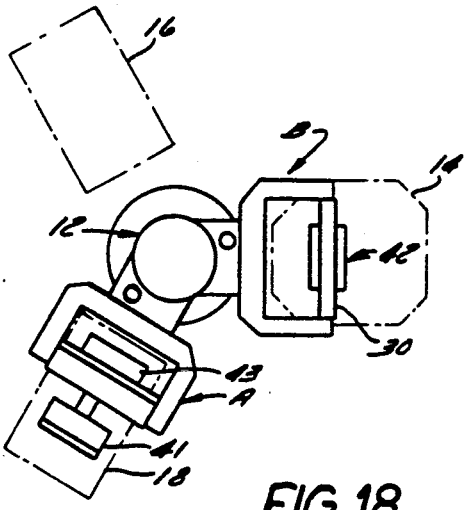

FIG. 18, the mold sections 41, 43 in assembly A are rotating to the vertical for mold coating while assembly B is located at the furnace 14 to complete the filling of the mold 42.

Figure 19:
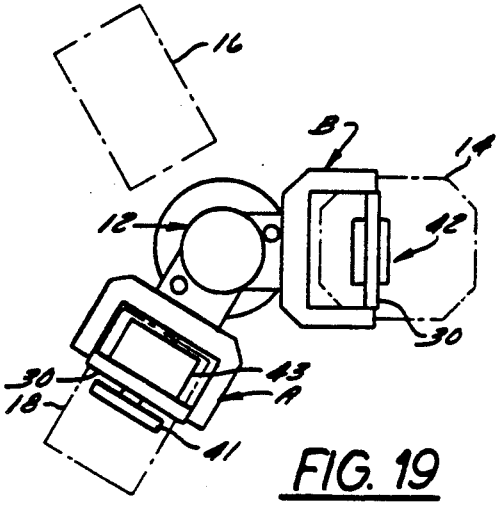

FIG. 19, in assembly A the mold sections have been rotated to the vertical position for mold coating, while assembly B remains at the furnace to allow the mold 42 to fill with molten metal.

The motion of assembly A and assembly B are reversed to complete each cyclé of operation. The anticipated time for each assembly to cycle from a starting position either at the wash stand or at the furnace and back is approximately 60 seconds. In that period of time, a minimum of two castings can be formed. Although the manipulator arms have been shown and described as rotating with respect to a pedestal, it is also within the contemplation of this invention to independently move the manipulator assemblies linearly to and from each side of the furnace to the wash stations. The assemblies could also be rotated 180° to a single wash stand if desired.

Thus, it should be apparent that there has been provided in accordance with the present invention a low pressure double arm casting apparatus that fully satisfies the aims and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A low pressure casting apparatus comprising:

a pedestal;

a low pressure casting furnace disposed in a spaced relation to said pedestal;

a pair of immersion stations located in equally spaced relation to said pedestal and to said furnace;

a first arm mounted for rotary motion on said pedestal between one of said immersion stations and said furnace;

a second arm mounted for rotary motion on said pedestal between said other immersion station and said furnace;

bearing means mounted on said pedestal below each of said arms wherein said arms ride on said bearing means on said pedestal;

a casting mold mounted on each of said arms and being disposed for movement into operative engagement with said immersion station and said casting furnace; and means for cycling each of said arms independently of the other of said arms, said cycling means includes a pair of ring gears mounted on said pedestal and a drive motor assembly mounted on each arm in a position to operatively engage said corresponding ring gear, radial bearing means located in said ring gears for countering lateral forces transverse to said pedestal, whereby one of said arms can be stopped for maintenance or repair without interrupting the motion of the other of said arms.

2. A casting apparatus comprising:

a base;

a casting furnace positioned in a spaced relation to said base;

a pair of immersion stations located in a spaced relation to said base and to said furnace;

an upper arm mounted for rotary motion on said base;

a lower arm mounted for rotary motion on said base;

a thrust bearing assembly mounted on said base to support each of said arms;

a mold manipulator assembly mounted on each of said arms, one of said assemblies being disposed for movement into operative engagement with one of said immersion stations and said casting furnace and the other of said arms being disposed for movement in operative engagement with the other of said stations and said casting furnace; and means for moving each of said arms in opposite directions from said furnace, said moving means includes a pair of ring gears mounted on said base in a spaced relation and a drive motor assembly mounted on each arm in a position to operatively engage said corresponding ring gear; a radial bearing in each of said ring gears, whereby one of said arms can be stopped for maintenance or repair without stopping the motion of the other of said arms.

* * * * *